United States Patent [19]

Domoto et al.

[11] Patent Number: 4,746,410

[45] Date of Patent: May 24, 1988

[54] CURRENT COLLECTING ASSEMBLY FOR A ROTATABLE BODY

[75] Inventors: Takeshi Domoto, Ageo; Yoshi Kanno, Hitachi, both of Japan

[73] Assignees: Mitsui Kinzoku Kogyo Kabushiki Kaisha, Tokyo; Kabushiki Kaisha Takahashi Denki Seisakusho, Hitachi, both of Japan

[21] Appl. No.: 12,268

[22] Filed: Feb. 9, 1987

[30] Foreign Application Priority Data

Feb. 13, 1986 [JP] Japan ..... 61-27793

[51] Int. Cl.[4] ..... C25D 17/00

[52] U.S. Cl. ..... 204/216; 204/218

[58] Field of Search ..... 204/212, 216, 218

[56] References Cited

U.S. PATENT DOCUMENTS 3,660,265 5/1972 Kankas ..... 204/216

4,519,887 5/1985 Shigeta ..... 204/212

*Primary Examiner*—T. M. Tufariello

*Attorney, Agent, or Firm*—Thomas H. Whaley

[57] ABSTRACT

A current collecting assembly for a body, such as an electrodepositing drum, mounted to rotate about a shaft (16) includes a current collector removably connected to an end of the shaft (16), a current conductor (12) connected to a current supply conductor (19) and means (13,14) for pressing a contact portion (12*a*) of the current conductor means (12) against the current collector (11) with a predetermined pressure. The contact portion (12*a*) is carried by a hollow body (12*b*) through which water is passed to water cool the contact portion (12*a*).

14 Claims, 3 Drawing Sheets

CURRENT COLLECTING ASSEMBLY FOR A ROTATABLE BODY

The present invention relates to current collecting assemblies for rotatable bodies and is concerned with such assemblies of the type which are for use with a body mounted to rotate about a shaft and comprise current collector means, current conductor means adapted to be connected to a current supply conductor and means for pressing a contact portion of the current conductor means against the current collector means with a predetermined pressure. The invention relates also to a body mounted for rotation including such a current collecting assembly and is particularly concerned with the case in which the body constitutes the electrodepositing drum of an apparatus for electrolytically manufacturing copper foil.

A known copper foil manufacturing apparatus is illustrated diagrammatically in FIGS. 5 and 6. The apparatus includes an electrolysis cell 1 which contains an electrolyte 5 and an electrodepositing drum 2 which is rotatable mounted on a shaft 3 supported in bearings 4.

If $CuSO_4$ is used as the electrolyte and the electrolytic cell 1 and the electrodepositing drum 2 are respectively made positive and negative, the supply of an electric current causes the deposition of copper on the surface of the electrodepositing drum 2 and stripping the deposited copper from the drum produces copper foil.

The electrical connection to the electrodepositing drum 2 is effected through the rotary shaft 3. It has been the practice in the past to use a connecting or current collecting assembly of the type employing a combination of carbon brushes and slip rings or of the contact ring type employing a low-melting metal as a contact medium.

In assemblies of the type employing a combination of carbon brushes and slip rings, the maximum permissible current density in the carbon brushes is as small as 10 to 30 $A/cm^2$ and these are therefore not suitable for use as current collecting assemblies for electrodepositing drums for manufacturing copper foil which may require a current flow of as much as 22,000 A/drum. Moreover, the carbon powder of the carbon brushes tends to scatter over the surface of the electrodepositing drum which results in a not insignificant detrimental effect on the quality of the copper foil.

On the other hand, current collecting assemblies of the low-melting metal type involve the risk of the vapour of the low-melting depositing on the surface of the copper foil and substantially impairing the external appearance of the copper foil.

It is an object of the invention to overcome the disadvantages referred to above and in particular to provide a current collecting assembly which exhibits a reduced voltage drop and permits a substantial current flow over a reduced contact area and does not result in damage to the quality of the copper foil produced.

According to the present invention, a current collecting assembly of the type referred to above is characterised in that means for water cooling the contact portion are provided and that the current collector means are adapted to be removably connected to the shaft. The assembly preferably includes at least one spring which acts between two surfaces to press the contact portion against the current collector means and means which are arranged to move one of the two surfaces to vary the contact pressure. The current collector means is preferably made of copper and the contact portion is preferably made of silver-tungsten or copper-tungsten.

The means for water cooling preferably comprises a hollow body through which water may be passed and which carries the contact portion and on which the means for pressing acts.

The invention also embraces a body mounted for rotation about a shaft including an assembly of the type referred to above in which the current collector means is removably connected to one end of the shaft, and the current collector means affords an aperture, which is preferably coaxial with the shaft, whose surface is inwardly tapered, e.g. of frusto conical form, and engaged by a projection on the contact portion, e.g. the end thereof. Alternatively, the contact may be by way of a projection on the current collector means which extends into an aperture or recess on the contact portion. In an alternative embodiment the current collector means comprises one or more annular rings removably connected around one end of the shaft, the periphery of the or each ring being engaged by one or more contact portions.

The body may be any rotatable body to which it is desired to supply electric power but the invention is particularly concerned with the case in which the body is the electrodepositing drum of the apparatus for electrolytically manufacturing copper foil.

Further features and details of the present invention will be apparent from the following description of two specific embodiments which is given by way of example with reference to FIGS. 1 to 6 of the accompanying diagrammatic drawings in which.

Figure 1:
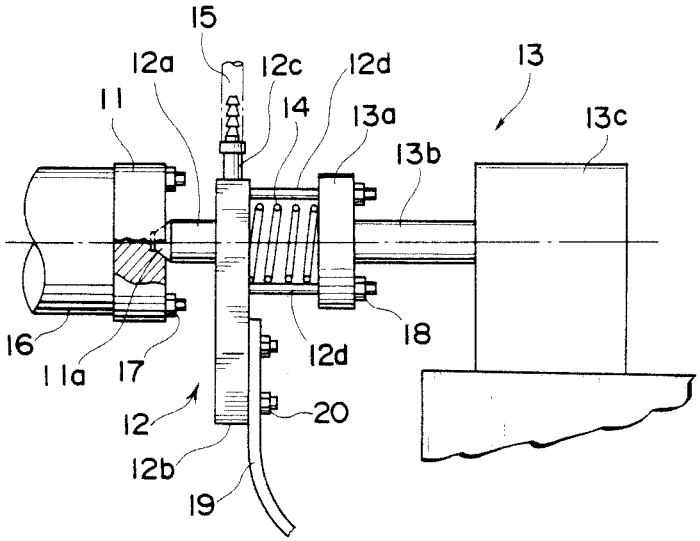
FIG. 1 is a side view of the first embodiment of current collecting assembly for copper foil manufacturing apparatus.
Figure 2:
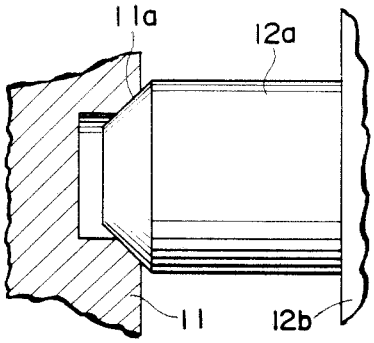
FIG. 2 is an enlarged view of the contacting portions of the current collector and the current conductor.

Referring firstly to FIGS. 1 and 2, the assembly includes a current collector 11 which defines an aperture affording a concave, frusto-conical contact surface 11*a* and a current conductor assembly 12 which carries a projecting contact portion 12*a* which contacts the surface 11*a*. The current collector 11 is made of copper and removably connected to the end of the shaft 16 of an electrodepositing drum (not shown) by means of bolts 17 and the surface 11*a* is coaxial with the shaft. The contact portion 12*a* is of silver-tungsten and connected by silver soldering to the front of a cooler 12*b* through which, in use, water is circulated via inlet and outlet ports 12*c* which are connected to hoses 15.

The cooler 12*b* is carried by a positioning assembly 13 and connected to a guide plate 13*a* thereof by four spindles or bolts 12*d* which are connected to the back of the cooler 12*b* and pass through holes in the guide plate 13*a* and carry nuts 18. The spindles 12*d* are spaced around a coil spring 14 which engages both the cooler 12*b* and the guide plate 13*a*. The guide plate 13*a* is connected to a positioning mechanism 13*c* by a shaft 13*b* which is coaxial with the shaft 16. A power supply member or cable 19 is attached to the cooler 12b by bolts 20.

In use, the positioning mechanism 13c is operated to adjust the position of the guide plate 13a in such a manner that the coil spring 14 causes the contact portion 12a to engage the contact surface 11a with a predetermined force. The shaft 16 and current collector 11 are rotated whilst the contact portion 12a is held stationary, thereby maintaining sliding contact between them to supply electrical power from the conductor assembly to the collector and thus the electrodepositing drum. Water is passed through the cooler 12b and thus the heat generated by the flow of electric current through the current collector 11 and the contact portion 12a is removed. The current density can therefore be as large as 900 A/cm$^2$. Also, the contact resistance is so small that the voltage drop is reduced to about 50 mV which is similar to that in a current collecting assembly of low-melting metal medium type.

Figure 3:
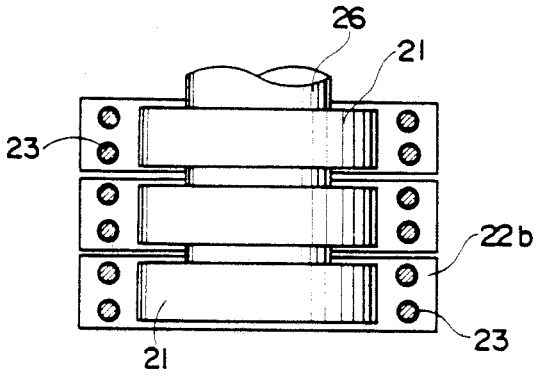
FIG. 3 is a plan view of the second embodiment.
Figure 4:
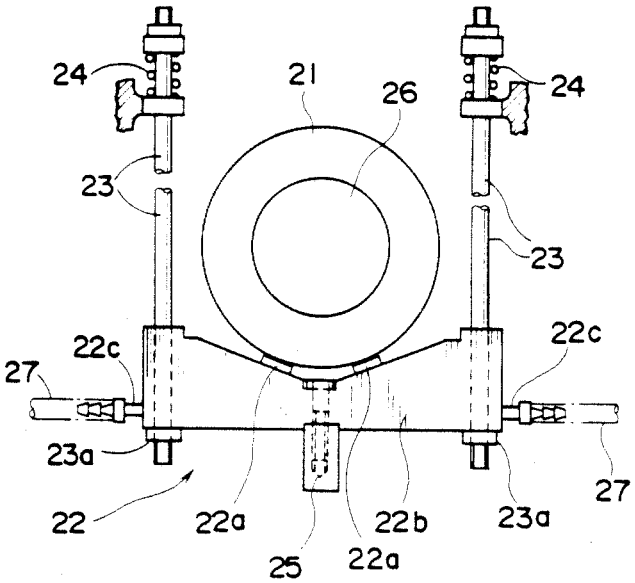
FIG. 4 is a front elevational view of the embodiment of FIG. 3.
Figure 5:
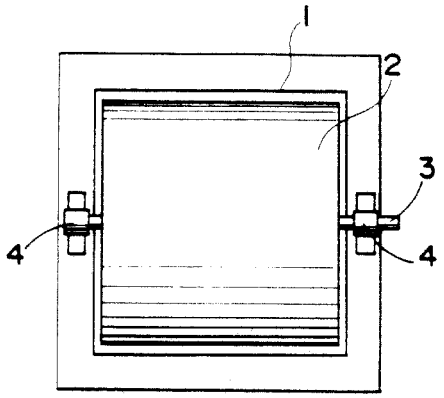
FIG. 5 is a diagrammatic plan view of an electrolysis cell for manufacture of copper foil.
Figure 6:
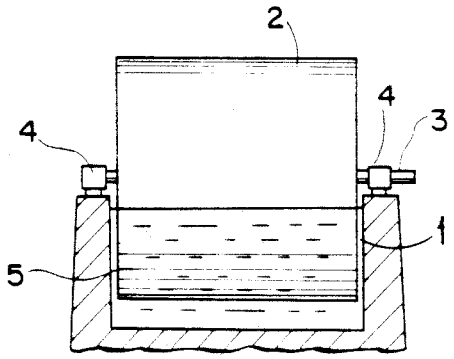
FIG. 6 is a front elevational view, partly in cross section, of the electrolysis cell of FIG. 5.

In the embodiment of FIG. 3, one or more, and in this case three, annular current collectors 21 of copper extend around an end of the shaft 26 of an electrodepositing drum (not shown). Each current collector is engaged on its outer periphery by one or more, in this case two, contact portions 22a of silver-tungsten fastened to respective cooling members 22b. Each cooling member is of elongate form and carried at each end by two spaced spindles or bolts, one end of each of which passes through a respective hole in the cooling member and carries a nut 23a and the other end of which passes through a respective coil spring 24 and is connected to a supporting structure (not shown). Each coil spring engages a fixed shoulder and a shoulder on the associated spindle 23. In use, water is circulated through the cooling members 22b via holes 27 and water inlet and outet ports 22c and a power supply member or cable (not shown) is connected to each cooling member. The nuts 23a are tightened so that the contact portions 22a contact the current collectors 21 with a predetermined pressure. The current collectors 21 are of copper and the contact portions 22a are of silver-tungsten type and the conductor assembly 22 is water cooled and thus a large current density of e.g. up to 900 A/cm$^2$ may be achieved and the contact resistance is reduced thereby decreasing the voltage drop to about 50 mV.

In modified constructions, the contact portions 12a and 22a are of copper-tungsten.

In the current collecting assembly according to the invention, the conductor assembly is water cooled and pressed against the current collector mounted on the shaft of the rotatable body with a given pressure, and thus various advantages are achieved: The current density of the contacting surfaces may be as large as 900 A/cm$^2$ and thus the current collecting assembly may be smaller and more compact than previously. The contact resistance is reduced, thereby reducing the voltage drop to as small as 50 mV, The collector contact may be easily replaced. The occurrence of dust and fumes at the contacting surfaces is prevented, thereby improving the quality of the copper foil produced.

We claim:

1. A current collecting assembly for a body mounted to rotate about a shaft (16) comprising current collector means (11), current conductor means (12) adapted to be connected to a current supply conductor (19) and means (13,14) for pressing a contact portion (12a) of the current conductor means (12) against the current collector means (11) with a predetermined pressure, characterised in that means (12b) for water cooling the contact portion (12a) are provided and that the current collector means (11) are adapted to be removably connected to the shaft (16).

2. An assembly as claimed in claim 1 characterised by at least one spring (14) which acts between two surfaces (12b,13a) to press the contact portion (12a) against the current collector means and by means (13c) arranged to move one of the two surfaces to vary the contact pressure.

3. An assembly as claimed in claim 1 characterised in that the current collector means (11) is made of copper.

4. An assembly as claimed in claim 1 characterised in that the contact portion (12a) is made of silver-tungsten or copper-tungsten.

5. An assembly as claimed in claim 1 characterised in that the means for water cooling comprises a hollow body (12b) through which water may be passed and which carries the contact portion (12a) and on which the means for pressing (13,14) acts.

6. A body mounted for rotation about a shaft (16) characterised by an assembly as claimed in claim 1, the current collector means (11) being removably connected to one end of the shaft, one of the current collector means (11) and the contact portion (12a) having an aperture whose surface (11a) is inwardly tapered and engaged by a projection on the other of the current collector means (11) and the contact portion (12a).

7. A body as claimed in claim 6 characterised in that it constitutes the electrodepositing drum of an apparatus for electrolytically manufacturing copper foil.

8. A body as defined in claim 6 wherein the current collector means (11) is made of copper and the contact portion (12a) is an alloy of tungsten and a metal selected from the group consisting of silver and copper.

9. A body as defined in claim 6 wherein the means for water cooling comprises a water reservoir (12b) in intimate contact with contact portion (12a).

10. A body mounted for rotation about a shaft (16) characterised by an assembly as claimed in claim 1, the current collector means comprising one or more annular rings (21) removably connected around one end of the shaft (16), the periphery of the or each ring (21) being engaged by one or more contact portions (22a).

11. A body as claimed in claim 10 characterized in that said body constitutes an electrodepositing drum of an apparatus for electrolytically manufacturing copper foil.

12. A body as defined in claim 10 wherein annular ring (21) of the current collector means is made of copper and the contact portion (22a) is made of an alloy of tungsten and a metal selected from the group consisting of silver and copper.

13. A body as defined in claim 10 wherein the means for water cooling comprises a water reservoir (22b) in intimate contact with the contact portion (22a).

14. A body as defined in claim 10 wherein the means for water cooling comprises a hollow chamber (22b) through which water may be passed.

* * * * *